US006880186B2

(12) United States Patent
Johansson

(10) Patent No.: US 6,880,186 B2
(45) Date of Patent: Apr. 19, 2005

(54) ARRANGEMENT IN A BED FOR A DISABLED PERSON, AND A BED PROVIDED WITH THE SAID ARRANGEMENT

(76) Inventor: Bengt Johansson, PL 215, S-471 90 Kyrkesund (SE)

( * ) Notice: Subject to any disclaimer, the term of this patent is extended or adjusted under 35 U.S.C. 154(b) by 4 days.

(21) Appl. No.: 10/362,529

(22) PCT Filed: Aug. 24, 2001

(86) PCT No.: PCT/SE01/01807

§ 371 (c)(1),
(2), (4) Date: Feb. 25, 2003

(87) PCT Pub. No.: WO02/15834

PCT Pub. Date: Feb. 28, 2002

(65) Prior Publication Data

US 2004/0006819 A1 Jan. 15, 2004

(30) Foreign Application Priority Data

Aug. 25, 2000 (SE) ..... 0003008

(51) Int. Cl.[7] ..... A61G 7/15

(52) U.S. Cl. ..... 5/81.1 R; 5/83.1; 5/89.1

(58) Field of Search ..... 5/81.1 R, 83.1, 5/84.1, 85.1, 88.1, 89.1, 612, 618

(56) References Cited

U.S. PATENT DOCUMENTS 5,095,561 A * 3/1992 Green et al. ..... 5/618
5,444,883 A 8/1995 Iura

FOREIGN PATENT DOCUMENTS

GB 640791 7/1950

* cited by examiner

*Primary Examiner*—Heather Shackelford
*Assistant Examiner*—Fredrick Conley
(74) *Attorney, Agent, or Firm*—Young & Thompson

(57) ABSTRACT

An arrangement in a bed (1) intended for a disabled person and comprising a horizontally rotatable multi-sectional bed base part (3*a*, 3*b*) supporting a mattress, the base part being convertible into a seat part (3*b*) and a backrest part (3*a*), together with a fixed bed base part (3*c*). The arrangement furthermore comprises a lifting mechanism 82*a*) connected to the rotatable bed base parts (3*a*, 3*b*) supporting the mattress, the mechanism 82*a*) being operatively connected to a safety hook (A), that can be connected to a lifting sling, for example, which is worn by the person.

6 Claims, 4 Drawing Sheets

ARRANGEMENT IN A BED FOR A DISABLED PERSON, AND A BED PROVIDED WITH THE SAID ARRANGEMENT

The present invention relates to an arrangement in a bed intended for a disabled person, and more specifically an arrangement by means of which the said person can be lowered down onto and raised up from a bed, and a bed provided with the said arrangement.

For obvious reasons, a disabled (paralysed or senile) person has difficulty getting in and out of bed. Helping such a person out of bed and into bed is therefore a daily task for relatives or nursing staff. Such lifting carries with it considerable risk of injury because the posture of the person(s) assisting is in most cases extremely unfavourable in terms of the load stresses sustained.

There are great benefits in enabling disabled people to continue to live and work in a familiar home environment. Being able to manage for as long as possible without personal assistance from others is likewise desirable not only for reasons of cost, but also from the purely personal standpoint of those affected. Various technical aids are often essential in enabling people with restricted mobility to carry on living and coping at home whilst maintaining an acceptable quality of life.

U.S. Pat. No. 5,444,883 shows a bed with rotatable mattress part which makes it easier for a disabled person to get in and out of bed. This known bed assumes, however, that the person has sufficient mobility and strength in their arms to be able get up, unassisted, from a sitting position on the bed and down into a wheel chair, or into a standing position.

The main object of the present invention is to provide an arrangement in a bed, which can be used as an aid when rising from a bed or getting into a bed and which solves the aforementioned problems of heavy lifting, and which provides the facility to enable even a seriously disabled person to get into bed and up from the bed by themselves.

According to the invention this object is achieved in that the arrangement has the characteristics specified in the claims.

Another advantage of the invention is that the process of getting into and out of a bed can be tailored to each individual, modified movement patterns being readily achievable not only through motorised control of a rotatable part of the bed base with associated mattress part, but also through motorised control of an integrated lifting mechanism. A further advantage of the invention is that even very heavy persons can be safely lifted into and out of bed from a wheel chair, for example, without the risk of the bed overturning.

Figure 1:
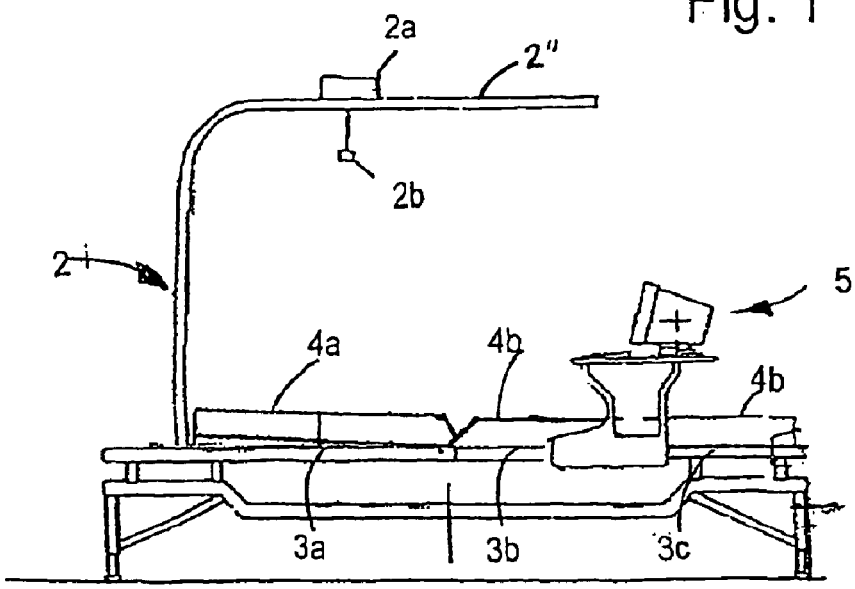
Figure 2:
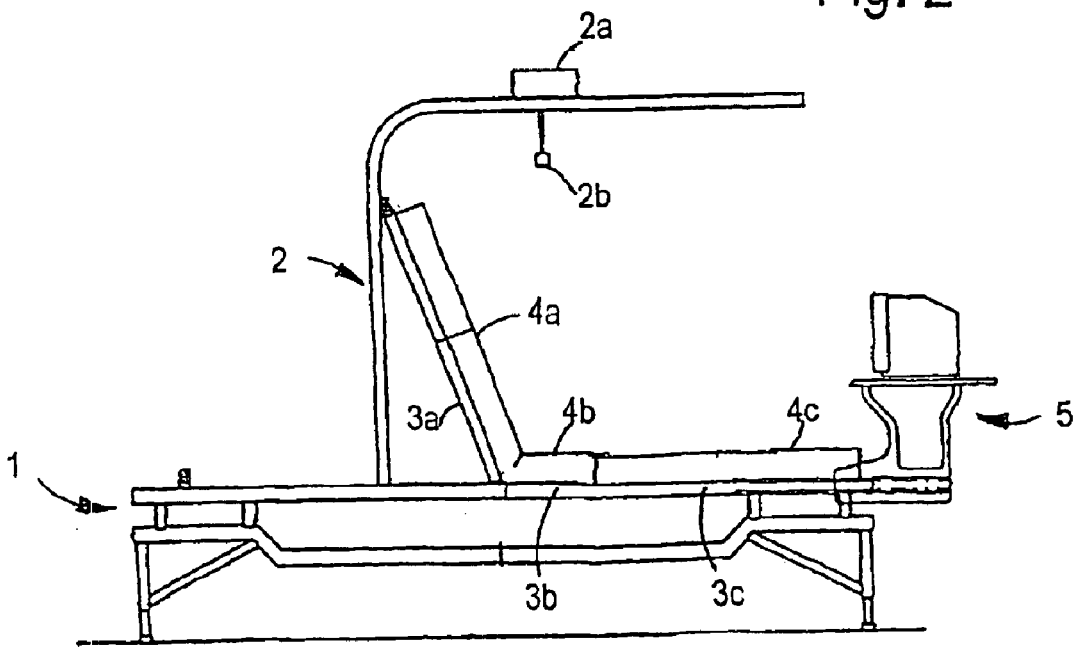
Figure 3:
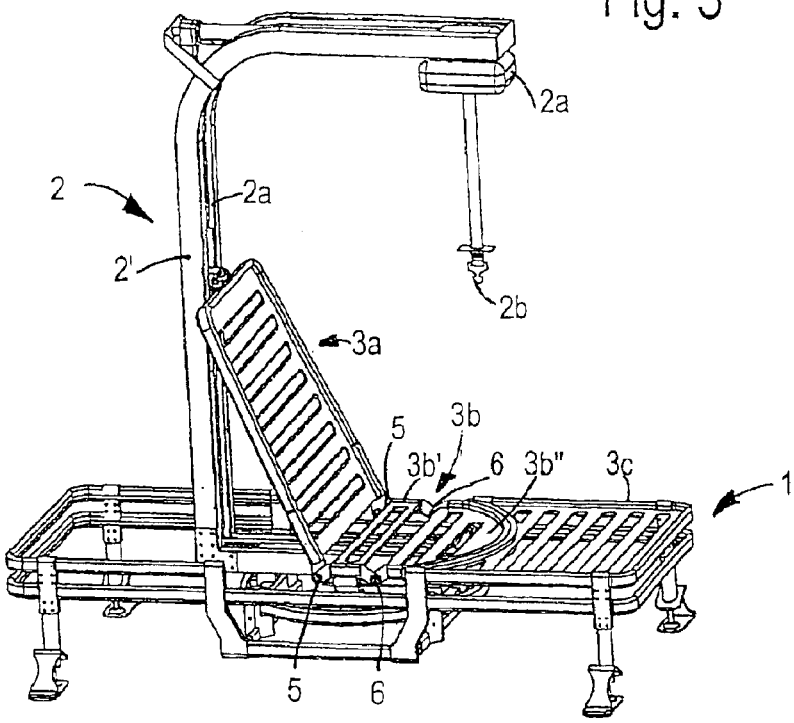
Figure 4:
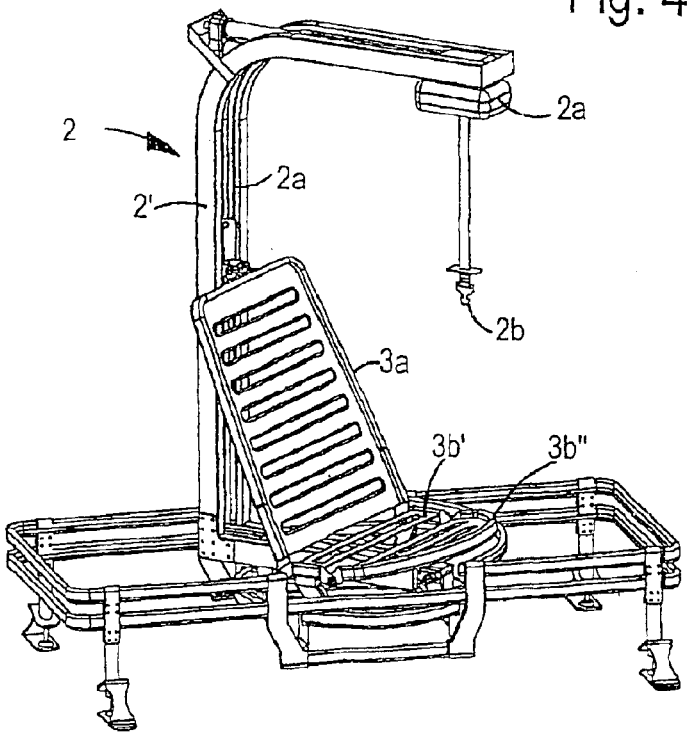
Figure 5:
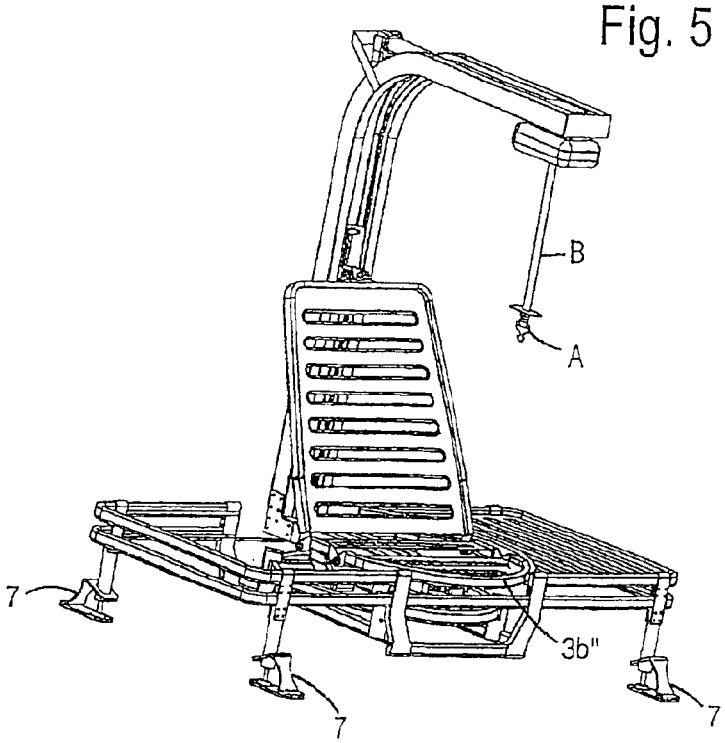
Figure 7:
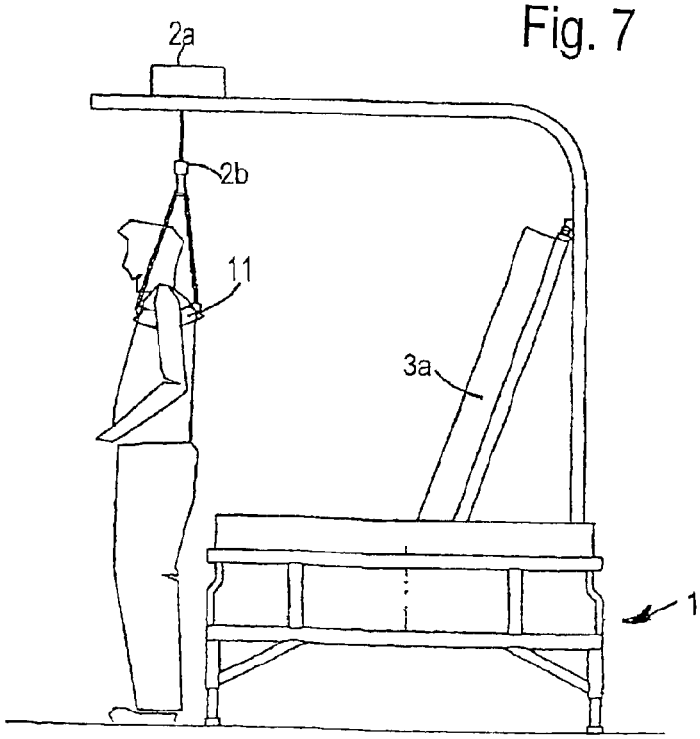
Figure 6:
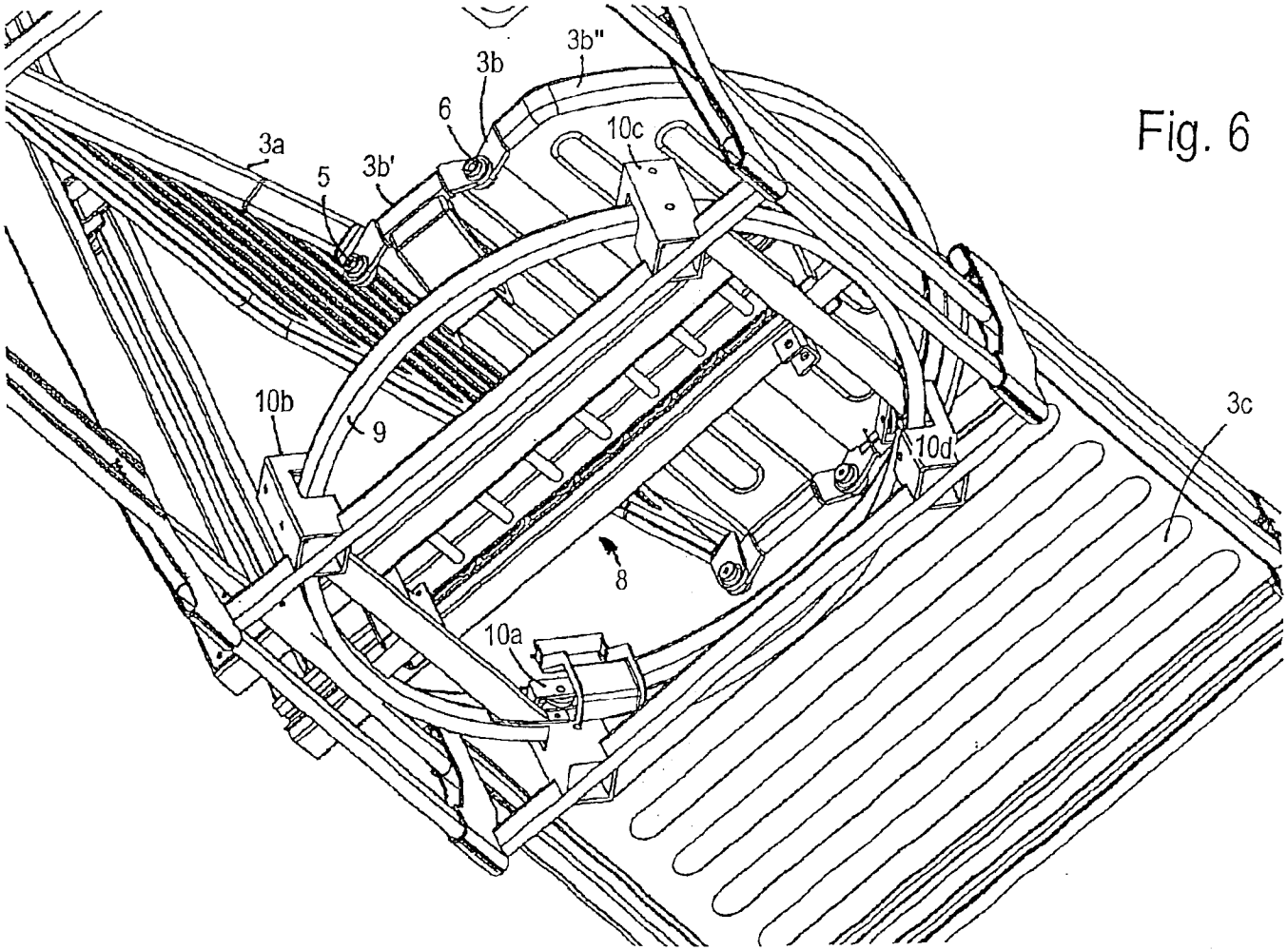

The invention will now be described with reference to exemplary embodiments shown in the drawing attached, in which FIG. 1 shows a simplified, diagrammatic side view of an arrangement in a bed according to the invention in a lowered position, FIG. 2 shows a diagrammatic side view corresponding to FIG. 1 of an arrangement and bed part in a position with the patient sitting upright, FIG. 3 shows a perspective view corresponding to that in FIG. 2, but without mattress and showing various parts of the rotatable, multi-sectional bed base part supporting the mattress before commencing rotation of the bed base part, FIG. 4 shows the rotatable, multi-sectional bed base part supporting the mattress after a 45-degree turn, and in which the front section of this base part has been shown angled upright in order to retain the patient safely, FIG. 5 shows the rotatable, multi-sectional bed base part supporting the mattress after a 90-degree rotation into a position allowing a person to get in and out of bed, FIG. 6 shows a view of an arrangement according to the invention from beneath, and how the rotatable, multi-sectional bed base part supporting the mattress is operatively connected to a telescopically collapsible pedestal arrangement, and in which FIG. 7 shows a diagrammatic view from the end of the arrangement with the bed having a person secured in a lifting sling for getting into and out of the bed.

FIG. 1 shows a simplified, diagrammatic side view of an arrangement 2 in a bed 1 according to the invention with the backrest part/head end 3*a,* 4*a* in a in a lowered position. The arrangement 2 has a lifting mechanism 2*a* and a lifting hook 2*b* for the connection of a lifting sling—see further description in connection with FIG. 7. A specially designed and divided mattress 4*a–c* is also shown in FIG. 1. The lower mattress part 4*c* is immovable on the bed base part 3*c,* and is connected by a curved edge part (not visible in the figure) to the mattress part 4*b,* supported by the rotatable, multi-sectional bed base part 3*a*. The mattress part 4*a* is suitably fixed to the bed base part 3*a* by Velcro tape, or the like. The reference number 5 relates to a bedside table, which is moveably arranged by the bed 1 and can be pushed aside and, if necessary, lowered when making the bed whilst simultaneously lifting the patient.

FIG. 2 shows a side view of the bed 1 according to FIG. 1, with backrest part/head end 3*a*/4*a* in a raised position, permitting an upright sitting position in the bed 1.

FIG. 3 shows a view of an arrangement 2 and bed 1 corresponding to that in FIG. 2, but here in a perspective view and without mattress and showing various parts 3*a,* 3*b* and 3*c* of the rotatable, multi-sectional bed base part supporting the mattress before commencing a rotation of the bed base part 3*a,* 3*b*. Here therefore, the bed base part is shown divided into two parts moveable in relation to one another, the bottom, fixed part 3*c,* together with middle part 3*b* and top part 3*a,* The pedestal 2' has an open slot 2*a,* the top section of the bed base part 3*a* being guided so that can slide in the said slot. The mattress parts 4*a–*4*c* therefore have shapes that correspond to the shapes of the bed base parts 3*a–*3*c,* which is an essential prerequisite if the mattress parts 4*a* and 4*b* and the bed base parts 3*a* and 3*b* are to be movable, turnable or rotatable in relation to the mattress 4*c* and bed base part 3*c*. It will also be seen from FIG. 3 that the bed base part 3*b* is articulated, partly at the bed base part 3*a,* at 5, but also at 6 in such a way that the bed base part 3*b* will comprise two parts 3*b*' and 3*b*" rotatable in relation to one another.

FIG. 4 shows in more detail why the bed base part 3*b* is divided up. The front part 3*b*" is, in fact, designed to be capable of swinging upwards in order to create a support for the patient's thighs, partly in order to provide a greater sense of security when the bed base part 3*a,* 3*b* is rotated with the patient seated, but also in order to raise the patient's lower legs, so as to minimise their pressure against the mattress part 4*c,* with the object of permitting a lateral swivelling of the lower legs and feet when the bed base part is rotated through 90 degrees into the position for getting out of bed.

FIG. 5 shows the rotatable, multi-sectional bed base part 3*a,* 3*b* supporting the mattress after a 90-degree rotation into a position allowing a person to get in and out of bed. Here the front bed base part 3*b*" is shown in a horizontal, reclined position, making lifting/getting out of bed and down into a wheel chair, for example, easier. It is obviously advantageous if the time that the patient spends suspended in a lifting sling can be minimised, a short lifting time being preferable not only due to risk of circulatory problems, but also purely from the point of view of comfort. FIG. 5 also shows arrangements 7 in the bottom part of the foot of the bed 1, designed to prevent overturning. These support arrangements 7 increase the moment arm counteracting the overturning of the bed 1. The said supports 7 can easily be turned in under the bed should their use not be necessary.

FIG. 6 shows a view of the rotatable bed base parts 3*a* and 3*b* from beneath, and of a telescopic mechanism 8, which is here shown in its fully telescoped position. The telescopic mechanism 8 assumes its fully extended position when the bed is in the position shown in FIG. 1, that is to say in the bed's sleeping position. In principle, one linear adjusting device suffices both for adjusting the bed base part 3*a* into an upright position and for adjusting the telescopic mechanism 8 into a telescoped position, since the top part of the bed base part 3*a* slides and is guided in the slot 2*a* in the pedestal 3*c*. FIG. 6 also shows how the bed base part 3*a*, 3*b* and telescopic part are arranged in the bed frame. A support and bearing ring 9 is fixed in the bed frame. The bed base part 3*a*, 3*b* and the telescopic part 8 are supported on the said ring by way of a bearing housing 10*a*–10*d*, which has supported rollers, which run against the upper side of the support and bearing ring. An outer gear tooth profile is suitably connected to one side of the support and bearing ring 9, in which gear tooth profile one or more gear wheels engage for rotation of the bed base part 3. In a preferred embodiment a toothed belt (not shown) is fixed to opposing outer sides of the bearing ring 9 and has a length such that the belt can pass over two tensioning wheels and a motor-driven toothed belt pinion wheel fixed to the bed frame in order to bring about rotation of the bearing ring and the bed base parts 3*a*, 3*b*. Limit switches on the bearing ring 9 limit the possible rotation.

FIG. 7 finally shows a diagrammatic view from the end of the arrangement with the bed having a person secured in a lifting sling 11 for getting into and out of the bed.

The invention is not confined to the exemplary embodiment shown above but lends itself to modifications within the scope of the claims set out below.

What is claimed is:

1. Arrangement in a bed (1) intended for a disabled person and comprising a horizontally rotatable multi-sectional bed base part (3*a*, 3*b*) supporting a mattress, the base part being convertible into a seat part (3*b*) and a backrest part (3*a*), together with a fixed bed base part (3*c*), characterised in that the arrangement furthermore comprises a lifting mechanism (2*a*) connected to the said rotatable bed base parts (3*a*, 3*b*) supporting the mattress, the mechanism (2*a*) being operatively connected to a safety hook (A), that can be connected to a lifting sling, for example, which is worn by the said person.

2. Arrangement according to claim 1, characterised in that the operative connection consist of a belt or a line (B).

3. Arrangement according to claim 1, characterised by a vertical pedestal (2') against which the backrest part (3*a*) of the said bed base slidably bears.

4. Arrangement according to claim 3, characterised in that the vertical pedestal (2') has, at the top, a horizontal beam part (2") accommodating a motor-driven winch mechanism (2*a*), arranged so that it can traversed along the said beam part (2").

5. Arrangement according to claim 3, characterised in that the vertical pedestal (2') is horizontally displaceable by means of a telescopic mechanism (8), which is rotatable together with the multi-sectional bed base part (3*a*, 3*b*).

6. Bed (1) for a disabled person, comprising an arrangement according to claim 1, characterised in that at least one laterally directed, moment-absorbing support (7) serving to prevent overturning, is arranged in connection with any leg of the bed.

* * * * *